United States Patent [19]

Hasegawa et al.

[11] 4,437,406

[45] Mar. 20, 1984

[54] INKING APPARATUS FOR AN OFFSET PRESS

[75] Inventors: Kokichi Hasegawa; Tsugio Tokita, both of Ibaragi, Japan

[73] Assignee: Komori Printing Machinery Co., Ltd., Japan

[21] Appl. No.: 389,831

[22] Filed: Jun. 18, 1982

[30] Foreign Application Priority Data

Sep. 12, 1981 [JP] Japan ..... 56-144339

[51] Int. Cl.[3] ..... B41F 31/00

[52] U.S. Cl. ..... 101/350; 101/148; 118/262

[58] Field of Search ..... 101/348, 349, 350, 351, 101/352, 207, 208, 209, 210, 148; 118/262

[56] References Cited

U.S. PATENT DOCUMENTS

| | | | |
|---|---|---|---|
| 2,448,975 | 9/1948 | Harrold et al. | 101/349 |
| 2,467,199 | 4/1949 | Faeber | 101/348 |
| 3,433,155 | 3/1969 | Norton | 118/262 X |
| 4,151,796 | 5/1979 | Uhrig | 101/350 X |
| 4,295,423 | 10/1981 | Johne et al. | 101/349 |

FOREIGN PATENT DOCUMENTS

| | | | |
|---|---|---|---|
| 2720315 | 1/1978 | Fed. Rep. of Germany | 101/349 |
| 61005 | 9/1969 | German Democratic Rep. | 101/349 |
| 1387514 | 3/1975 | United Kingdom | 101/349 |

OTHER PUBLICATIONS

"Solna Inker Simplified," *British Printer,* pp. 114–115, May 1974.

*Primary Examiner*—Edgar S. Burr
*Assistant Examiner*—Moshe I. Cohen
*Attorney, Agent, or Firm*—Remy J. VanOphem

[57] ABSTRACT

An inking apparatus including a first vibrator roller to which ink is intermittently transferred by a ductor roller from an ink fountain, a pair of second vibrator rollers held in contact with a plurality of ink form rollers held against a plate cylinder, a third vibrator roller, a first distributor roller held in contact with the first and third vibrator rollers, three second distributor rollers disposed in peripheral contact between the second vibrator rollers, a third distributor roller held in contact with a central one of the three second distributor rollers and the third vibrator roller, a fourth vibrator roller held in contact with one of the second distributor rollers which is located upstream of the central one thereof with respect to the direction of rotation of the plate cylinder, and a fourth distributor roller held in contact with the third vibrator roller and the fourth vibrator roller. A fifth distributor roller held in contact with one of the second vibrator rollers, which is positioned upstream of the other relative to the direction of rotation of the plate cylinder, and the fourth vibrator roller may be added.

2 Claims, 3 Drawing Figures

INKING APPARATUS FOR AN OFFSET PRESS

BACKGROUND OF THE INVENTION

The present invention relates to an inking apparatus for supplying ink to the printing plate mounted on a plate cylinder in an offset press.

Offset presses include a plate cylinder having a printing plate mounted thereon, an inking apparatus for supplying ink to the surface of the printing plate, and a dampening apparatus for supplying a dampening solution. The ink and dampening solution, as supplied, form an image on the surface of the printing plate, which image is transferred onto a blanket cylinder held in contact with the plate cylinder. The image on the blanket cylinder is then transferred onto and printed on a sheet of printing paper between the blanket cylinder and another blanket cylinder or between the blanket cylinder and an impression cylinder.

The known inking apparatus for the offset presses include a drum-type inking apparatus and a multiple-roller-type inking apparatus. The drum-type inking apparatus is disadvantageous in that it tends to cause ghosting. The multiple-roller-type inking apparatus has a drawback in that ink on rollers is liable to become emulsified. Both known types of inking apparatus are also unsatisfactory in that ink flow is not smooth, ink tends to get emulsified easily, and hence the apparatus are prone to bring about printing troubles.

SUMMARY OF THE INVENTION

It is an object of the present invention to provide an inking apparatus for offset presses which is capable of supplying a printing plate surface with ink smoothly for the prevention of ink emulsion due to a dampening solution added, to thereby provide a desired printing density and improve the quality of printed products.

Another object of the present inventin is to provide an inking apparatus for offset presses which can supply ink uniformly over a printing plate surface and in such amounts, through ink form roller groups located upstream and downstream with respect to the direction of rotation of a plate cylinder, that ink can be prevented from being emulsified and ghosting can be prevented from being generated.

Still another object of the present invention is to provide an inking apparatus for offset presses which includes an additional distributor roller to provide a uniform supply of ink to a printing plate surface and speed up evaporation of a dampening solution as it returns from the printing plate surface.

According to the present invention, an inking apparatus for an offset press includes a first vibrator roller, first and second groups of ink form rollers each including a second vibrator roller, and two vibrator rollers and six distributor rollers disposed between the first vibrator roller and the second vibrator rollers. With such an arrangement, the number of nips along a main stream of ink is reduced to improve the ink flow, and the number of nips between the vibrator rollers is increased for a uniform thickness of the ink layer supplied to a printing plate surface. The amount of ink supplied upstream, with respect to the direction of rotation of the plate cylinder, is increased to prevent ghosting from being produced. Another distributor is added in a passage of ink towards one of the ink form roller groups for improved ink distribution and speeding up of evaporation of a dampening solution, as it is being fed back from the plate cylinder.

The above and other objects, features, and advantages of the present invention will become apparent from the following description when taken in conjunction with the accompanying drawings in which certain preferred embodiments of the invention are shown by way of illustrative example.

DETAILED DESCRIPTION

Figure 1:
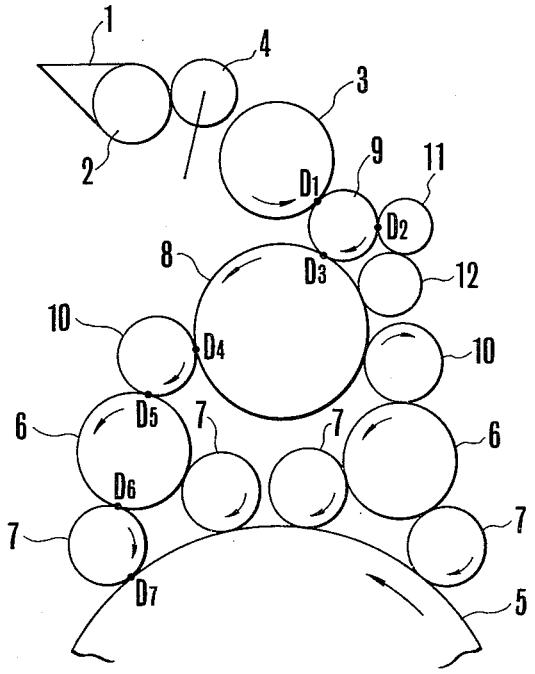
FIG.1 PRIOR ART
FIG. 1 is a schematic side elevational view of a conventional prior art drum-type inking apparatus.
Figure 2:
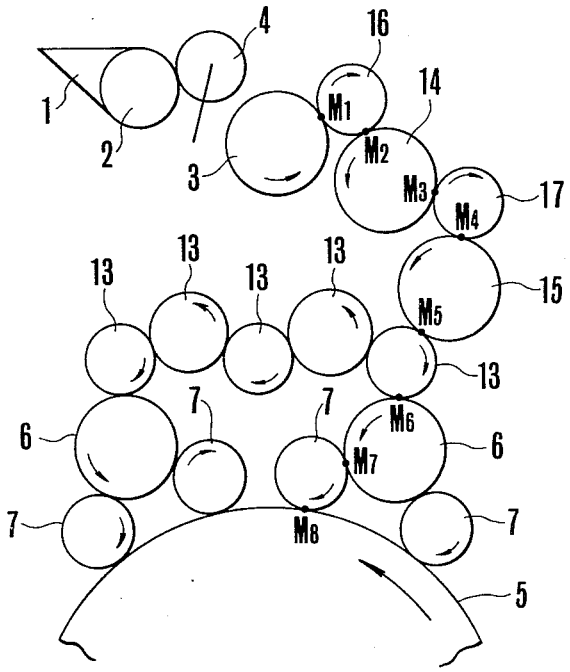
FIG.2 PRIOR ART
FIG. 2 is a schematic side elevational view of another conventional prior art multiple-roller-type inking apparatus.

FIG. 1 illustrates a conventional drum-type inking appartus for an offset press, and FIG. 2 shows a conventional multiple-roller-type inking apparatus for an offset press. Each of the inking apparatus shown in FIGS. 1 and 2 includes an ink fountain 1, a fountain roller 2 disposed in the ink fountain 1, a vibrator roller 3, and a ductor roller 4 reciprocably movable between the rollers 2 and 3. A plurality of ink form rollers 7 are supported by arms (not shown) on a pair of vibrator rollers 6 and disposed in abutting relationship to a plate cylinder 5 with a printing plate mounted thereon, the plurality of ink form rollers 7 being movable into and out of contact with the plate cylinder 5.

The drum-type inking apparatus shown in FIG. 1 also includes a larger-diameter drum 8 positioned between the vibrator roller 3 and the vibrator rollers 6, a distributor roller 9 located in peripheral contact with and between the drum 8 and the vibrator roller 3, and distributor rollers 10 located in peripheral contact with and between the drum 8 and the vibrator rollers 6. Other distributor rollers 11 and 12 are held in contact with a distributor 9 and the drum 8, respectively.

The multiple-roller-type inking apparatus illustrated in FIG. 2 includes five distributor rollers 13 consecutively disposed between the vibrator rollers 6, each of the distributor rollers 13 being in peripheral contact with adjacent distributor rollers 13. Two vibrator rollers 14 and 15 and two distributor rollers 16 and 17 are provided in peripheral contact with each other between the vibrator roller 3 and the one of the distributor rollers 13 which is positioned at a location upstream of the other distributor rollers 13 with respect to the flow of ink.

Operation of the known inking apparatus is as follows: Ink stored in the ink fountain 1 is brought up as the fountain roller 2 rotates, and is transferred intermittently to the vibrator roller 3 by the ductor roller 4 as the latter moves reciprocably. Then, the ink thus supplied is transferred from roller to roller while, at the same time, the ink is spread in the axial and circumferential directions of the rollers. The ink is finally supplied by the plurality of ink form rollers 7 onto the surface of the printing plate mounted on the plate cylinder 5.

One of the requirements the inking apparatus should meet is that ink which has been transferred intermittently by the ductor roller 4 from the fountain roller 2 to the vibrator roller 3 be supplied as uniformly onto the printing plate as possible. Such uniform ink supply is largely governed by the number of nips or points of contact, as indicated at $D_1$ through $D_7$ in FIG. 1 and $M_1$ through $M_8$ in FIG. 2 between each of the rollers from the vibrator roller 3 through the plate cylinder 5. Assuming, as an example, that the thicknesses of ink layers on two rollers are represented by 1 and 3 units, respectively, prior to passage through nips, the thicknesses of ink layers as they go beyond the nips are rendered even or uniform since they become $(1+3)/2=2$ units. The ink which has been transferred intermittently by the ductor roller 4 onto the vibrator roller 3 and hence has been deposited on the latter in different thicknesses, can be considered as being reduced to half in thickness each time the ink passes through one nip. Thus, the more nips along the shortest path from the vibrator roller 3 to the plate cylinder 5, the more uniformly the thickness of ink is supplied onto the plate cylinder 5.

It is also required that the inking apparatus supply ink as precisely in the pattern of an image to be printed as possible without causing ghosting. More specifically, when ink is supplied to the printing plate, the ink which corresponds to an image on the printing plate is consumed, and the ink which does not face the image is not consumed and is returned to the plurality of ink form rollers 7, on which ink is deposited in a pattern that is reverse in relation to the image on the printing plate. As the plurality of ink form rollers 7 make one revolution, a dark shade, generally known as ghosting, is printed, resulting in an unsightly printed pattern. Conversely, a light shade tends to appear on a printed pattern which is relatively dark. In order to prevent such ghosting, it is necessary that ink be supplied in a greater amount from one of the plurality of ink form rollers 7 which is located upstream with respect to the direction of rotation of the plate cylinder 5, and another of the plurality ink form rollers 7 which is located downstream supply a smaller amount of ink.

The inking apparatus should also allow new ink to flow smoothly while being transferred onto a sheet of printing paper. If the ink flow were not smooth, the ink would be heated while being blended, and would tend to become emulsified when reacting with a dampening solution supplied from a dampening apparatus. Therefore, unacceptable printing products would be produced, and a necessary printing density would not be gained.

The foregoing requirements will now be considered with respect to the drum-type inking apparatus. The rollers which are located downstream of the nips $D_4$ relative to the ink flow, at which nips ink is divided from its main flow, are equal in number for both of the groups of ink form rollers 7. Thus, the amounts of ink supplied from the groups of ink form rollers 7 onto the plate cylinder are the same, resulting in a tendency to cause ghosting. As to the multiple-roller-type inking apparatus, it is more advantageous than the drum-type inking apparatus in that the number of nips present are greater to distribute ink more evenly. However, the number of rollers for one of the ink form roller groups, downstream of the nip $M_6$ where ink is divided from its main flow, is greater than that of rollers for the other group of ink form rollers, an arrangement which prevents ghosting from being produced, but allows ink to remain longer in the roller group in which there are more distributor rollers 13, so that ink is apt to be easily emulsified.

The prior art inking apparatus are further disadvantageous in that the number of nips between the vibrator roller 3 and the dividing nip $D_4$ or $M_6$ is four or six, which is relatively great. This means that there are many nips through which a thick layer of ink, as supplied from the ductor roller 4, passes. With the ink which passes through the nips being limited in amount, the ink does not flow smoothly and tends to become emulsified while going through the nips, resulting in various printing inaccuracies as described above.

Figure 3:
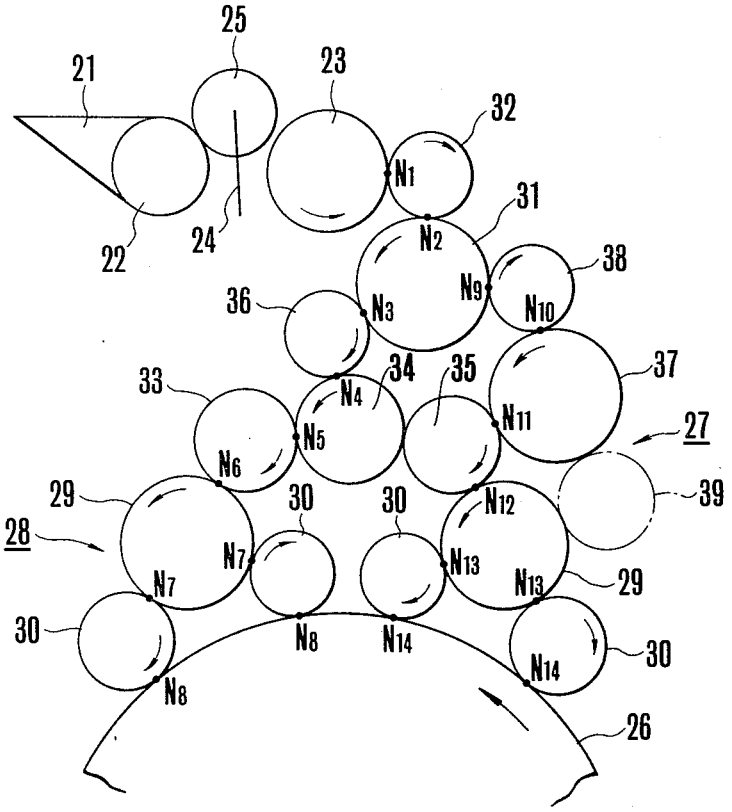
FIG. 3 is a schematic side elevational view of an inking apparatus for an offset press according to the present invention.

An inking apparatus according to the present invention will now be described with reference to FIG. 3.

The inking apparatus includes an ink fountain 21, a fountain roller 22 mounted for rotation in the ink fountain 21, a first vibrator roller 23, and a ductor roller 25 supported by a roller arm 24 and disposed reciprocably between the fountain roller 22 and the first vibrator roller 23. Ink contained in the ink fountain 21 is attached to the peripheral surface of the fountain roller 22 and brought up when the fountain roller 22 rotates. The ink is then transferred intermittently from the fountain roller 22 onto the first vibrator roller 23 as the ductor roller 25 is reciprocably swung back and forth by the roller arm 24. A first group of ink form rollers 28 and a second group of ink form rollers 28 are disposed upwardly of a plate cylinder 26 having a printing plate mounted thereon. Each of the first and second ink form roller groups 27 and 28 includes second vibrator roller 29 and a pair of ink form rollers 30 supported by roller arms (not shown) at the ends of a shaft of the vibrator roller 29 and held at all times in contact with the vibrator roller 29. Ink form rollers 30 are movable into and out of contact with the plate cylinder 26.

A first distributor roller 32 is positioned below the first vibrator roller 23 with a third vibrator roller 31 disposed in peripheral contact therewith. Between the vibrator rollers 29 of the first and second ink form roller groups 27 and 28, there are disposed three second distributor rollers 33, 34 and 35, consecutively disposed and held in peripheral contact with adjacent second distributor rollers and with the vibrator rollers 29. A third distributor roller 36 is held in peripheral contact with the central second distributor roller 34 of the three distributor rollers 33, 34 and 35 and with the third vibrator roller 31. A fourth vibrator roller 37 and a fourth distributor roller 38 are held in peripheral contact with each other and respectively with the second distributor roller 35 which is upstream with respect to the direction of rotation of the plate cylinder 26 relative to the third vibrator roller 31. With the rollers thus arranged, there are defined nips $N_1$ through $N_{14}$ between the first vibrator roller 23 and the plate cylinder 26. The rollers, when in operation, rotate in the directions indicated by the arrows as shown in FIG. 3.

The inking apparatus of FIG. 3 will operate as follows: Ink stored in the ink fountain 21 is attached to the peripheral surface of the fountain roller 22 as the latter rotates, and then is transferred intermittently from the fountain roller 22 to the first vibrator roller 23 by the ductor roller 25 as the latter is reciprocably moved back and forth by the roller arm 24. The ink on the vibrator roller 23 is transferred onto the third vibrator roller 31 through the nips $N_1$ and $N_2$, and then is divided by the nip $N_3$ into two flows. One ink flow goes through the nips $N_4$, $N_5$, $N_6$, $N_7$ and $N_8$ to the ink form roller 30 of the second group of ink form rollers 28, and then is supplied therefrom onto the printing plate on the plate cylinder 26. Ink in the other flow is supplied onto the plate cylinder 26 via the nips $N_9$, $N_{10}$, $N_{11}$, $N_{12}$, $N_{13}$ and $N_{14}$.

Various data obtained by the inking appartus according to the present invention and the prior inking apparatus as shown in FIGS. 1 and 2 are shown for comparison in the following table:

| | Inking apparatus of the invention | Drum-type inking apparatus | Multiple-roller-type inking apparatus |
|---|---|---|---|
| Number of nips in shortest ink path | 8 | 7 | 8 |
| Number of nips in main ink path | 3 | 4 | 6 |
| Rate of ink supply by first roller group | 61% | 50% | 87.5% |
| Rate of ink supply by second roller group | 39% | 50% | 12.5% |

The rate of ink supply was calculated for each nip by comparing the amount of ink prior to passage through the nip and the amount of ink subsequent to passage through the nip. The first roller group is the group of ink form rollers 27 which are located upstream with respect to the direction of rotation of the plate cylinder 26, and the second roller group is the group of ink form rollers 28 which are disposed downstream of the first roller group 27. The number of nips in a main ink path is the number of nips which are positioned between the first vibrator roller 3 or 23 and the point at which ink flow is divided into two ink paths.

With the third distributor roller 36, which forms the nips $N_3$ and $N_4$ being added according to the present invention, the number of nips in the main ink path is reduced without lowering the rate of ink distribution as indicated in the table, so that new ink can smoothly be supplied onto the printing plate mounted on the plate cylinder 26. Since the rate of ink supplied by the first roller group 27 is about 20% larger than that supplied by the second roller group 28, there is no danger of causing ghosting, which would otherwise be produced by ink supplied in equal amounts by the first and second ink form rollers as with the known drum-type inking apparatus. Furthermore, there is no risk of ink remaining longer on the rollers and, thereby, becoming emulsified, a disadvantage which would otherwise be caused by too many rollers in the ink flow path as with the prior art multiple-roller-type inking apparatus. The increased number of nips in the shortest ink flow path renders the thickness of an ink layer uniform as it flows through the nips from the first vibrator roller 23 on which the ink layer supplied intermittently by the ductor roller 25 or 4 has been irregular in thickness.

According to a modification of the present invention, a fifth distributor roller 39 as shown by the dot-and-dash line is disposed in peripheral contact with the fourth vibrator roller 37 and the second vibrator roller 29 in the first group of ink form rollers 27 which is located upstream with respect to the direction of rotation of the plate cylinder 26. With the fifth distributor roller 39 added, the rate of ink supplied by the first roller group 27 increased to 65%, and that by the second roller group 28 decreased to 36%, which data shows that the modified inking apparatus is as advantageous as the inking appartus of the invention with no distributor roller 39 included. The fifth distributor roller 39 also serves to improve ink distribution. Furthermore, the fifth distributor roller 39 tends to speed up evaporation of a dampening solution whichis transferred back from the plate cylinder 26 to the fourth vibrator roller 37 via the ink form rollers 30 and the second vibrator roller 29, and hence acts to cancel out adverse effects that a dampening apparatus has on the inking apparatus.

Although not shown, each roller in the path of the flow of ink may be equipped with a rider roller for increased ink distribution and dust removal. Addition of such rider rollers does not adversely affect the advantages of the present invention provided the basic roller arrangement remains the same.

While certain preferred embodiments have been shown and described in detail, it should be understood that many changes and modifications may be made therein without departing from the scope of the appended claims.

What is claimed as novel is as follows:

1. An inking apparatus for an offset press, comprising:

a fountain roller having ink thereon;

a first vibrator roller disposed adjacent said fountain roller and spaced apart therfrom;

a ductor roller interposed said fountain roller and said first vibrator roller, said ductor roller being reciprocably movable between said fountain roller and said first vibrator roller for intermittently transferring ink from said fountain roller to said first vibrator roller;

a plate cylinder rotatable in a predetermined direction;

a first roller group and a second roller group, each of said first and second roller groups comprising a plurality of ink form rollers held in contact with said plate cylinder, each of said first and second roller groups further comprising a second vibrator roller held in contact with said plurality of ink form rollers; said first roller group being located upstream of said second roller group with respect to said predetermined direction;

a third vibrator roller;

a first distributor roller interposed said first vibrator roller and said third vibrator roller, said first distributor roller being held in contact with said first vibrator roller and with said third vibrator roller;

three second distributor rollers one of said three second distributor rollers being held in contact with said second vibrator of said first roller group, an other of said three second distributor rollers being held in contact with said second vibrator of said second roller group, and an intermediate one of said three second distributor rollers being interposed said one and said other of said three second distributor rollers, said intermediate one of said three second distributor rollers being held in contact with said one and said other of said three second distributor rollers;

a third distributor roller held in contact with said intermediate one of said three second distributor rollers and with said third vibrator roller;

a fourth vibrator roller held in contact with said other of said three second distributor rollers and a fourth distributor roller interposed said third vibrator roller and said fourth vibrator roller, said fourth distributor roller being held in contact with said third vibrator roller and with said fourth vibrator roller.

2. An inking apparatus according to claim 1, further comprising a fifth distributor roller interposed said fourth vibrator roller and said second vibrator roller, of said first roller group, said fifth distributor roller being held in contact with said fourth vibrator roller and with said second vibrator roller of said first roller group.

* * * * *

UNITED STATES PATENT AND TRADEMARK OFFICE

CERTIFICATE OF CORRECTION

PATENT NO. : 4,437,406

DATED : March 20, 1984

INVENTOR(S) : Hasegawa, et al.

It is certified that error appears in the above-identified patent and that said Letters Patent is hereby corrected as shown below:

Column 1, line 39, delete "inventin" and insert ---- invention ----.

Column 4, line 24, delete "rollers 28" and insert ---- rollers 27 ----.

Column 4, line 28, after "includes" insert ---- a ----.

Column 4, line 32, delete "ink" and insert ---- The ink ----.

Column 5, line 32, after "$N_4$ " insert a comma ---- , ----.

Column 5, line 67, delete "whichis" and insert ---- which is ----.

Column 6, line 19, delete "therfrom" and insert ---- therefrom --.

Column 6, line 33, "rollers;" should read -- rollers, --.

Signed and Sealed this

Ninth Day of April 1985

[SEAL]

*Attest:*

DONALD J. QUIGG

*Attesting Officer* *Acting Commissioner of Patents and Trademarks*